United States Patent [19]

Saarinen

[11] Patent Number: 4,713,147

[45] Date of Patent: Dec. 15, 1987

[54] EXTENDED NIP PRESS WITH DISPLACEABLE CENTER OF GRAVITY FOR THE SUPPORTING FORCE

[75] Inventor: Esko Saarinen, Tampere, Finland

[73] Assignee: Oy Tampella AB, Tampere, Finland

[21] Appl. No.: 489,830

[22] Filed: Apr. 29, 1983

[30] Foreign Application Priority Data

May 5, 1982 [FI] Finland ..... 821584

[51] Int. Cl.[4] ..... D21F 3/06

[52] U.S. Cl. ..... 162/358; 100/118; 100/153; 162/205

[58] Field of Search ..... 162/358, 205; 100/118, 100/121, 153, 156

[56] References Cited

U.S. PATENT DOCUMENTS

| | | | |
|---|---|---|---|
| Re. 30,268 | 5/1980 | Justus | 162/358 X |
| 3,293,121 | 12/1966 | Martin | 162/358 |
| 3,974,026 | 8/1976 | Emson et al. | 162/358 |
| 4,287,021 | 9/1981 | Justus et al. | 162/205 X |

*Primary Examiner*—S. Leon Bashore

*Assistant Examiner*—K. M. Hastings

*Attorney, Agent, or Firm*—Ladas & Parry

[57] ABSTRACT

An extended nip press for a paper machine for removing water from a wet paper, cardboard or similar fibrous or porous web. The press comprises a rotating press roll and at least one loading shoe, which is pressed against the press roll so as to form an extended press zone. The loading shoe may pivot around an axis parallel to the axis of the press roll. The web to be dewatered is passed through the pressing zone together with at least one felt that receives water. The loading shoe is supported onto the support frame by the intermediate of a support means. The center of gravity of the support force applied by the support means to the shoe is displaceable in the direction of running of the web to be dewatered for the purpose of adjustment of the pressure pattern produced in the press zone when different paper qualities are run. The displacing of the center of gravity of the support force is performed either mechanically by shifting the support means in relation to the shoe, or hydraulically by changing the pressures in the two separate pressure cushions in the support means.

14 Claims, 7 Drawing Figures

EXTENDED NIP PRESS WITH DISPLACEABLE CENTER OF GRAVITY FOR THE SUPPORTING FORCE

Figure 1:
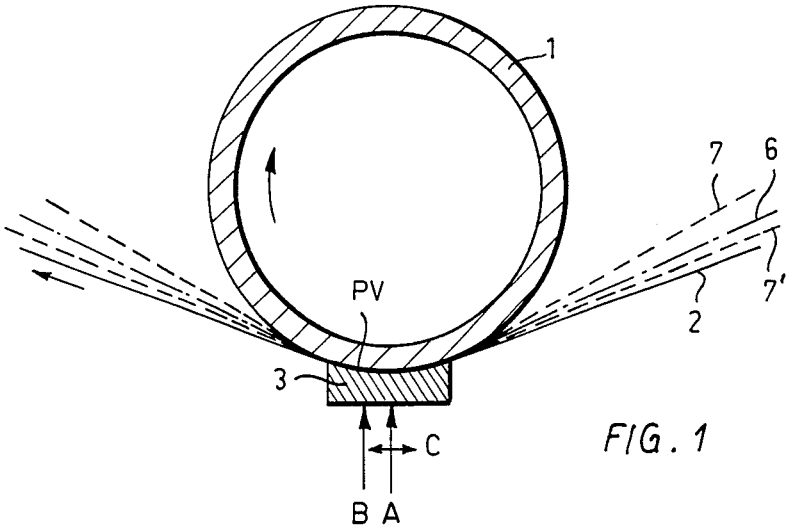

The present invention relates to an extended nip press for a paper machine for removing water from a wet paper, cardboard or similar fibrous or porous web, said press comprising a rotating press roll, at least one stationary loading shoe parallel to the axis of said press roll and pivotable around an axis parallel to said axis, said loading shoe together with said press roll forming an extended press zone, at least one dewatering felt passing between said press roll and a band for passing the web to be dewatered through the press zone, and a support means located between said loading shoe and the supporting frame thereof for applying a supporting force on said loading shoe, said supporting force pressing said loading shoe against said press roll.

It is known in prior art, in a press for a paper machine, to extend the zone where the web to be treated is pressed against the peripheral face of a press roll so that the press zone extends over a substantial distance in the direction of the periphery of said roll. The object is to keep the web in this way under pressure over a longer distance as the web passes through such an extended press nip so as to increase the dewatering capacity of the press.

When thin paper qualities are run, which suffer from the problem of rewetting, a pressure pattern is required in which the pressure peak occurs close to the trailing end of the press zone. Thicker cardboards, on the other hand, suffer from the problem of breakage of the structure if the pressure pattern is too sharp and the peak pressure is high. For this reason, a relatively even pressure pattern having a pressure peak close to the centre of the press zone is preferably used in connection with said thicker cardboards.

From U.S. Pat. Specification Re 30,268, an extended nip press is previously known, comprising a press roll and a flexible band which is pressed against a portion of the peripheral face of said roll. The press is provided with one or several loading shoes of the same length as the said roll, which are hydraulically pressed against the band. An extended press zone is formed on that area of the peripheral face of the press roll on which the shoe or the shoes load the band against the roll.

Each shoe is connected to a piston hydraulically loading said shoe by means of an articulated joint through which the supporting force of the piston acts on the shoe. When the press is being designed, the designer selects the location of the articulated joint with respect to the shoe and, accordingly, influences the pressure pattern which is produced by the shoe when the press is in operation. It is, however, later, impossible to change the location of the joint for different paper qualities, and the location of the joint must therefore be selected so as to obtain, on the average, an advantageous pressure pattern. For this reason, the pressure pattern produced by the shoe is at its optimum only for one paper quality, but is less well suited for other qualities.

The object of this invention is to provide an extended nip press which avoids the above-mentioned disadvantage and permits an adjustment of the pressure pattern of the press when different paper qualities are run. This object is achieved by means of a press according to the invention, which is characterized in that said support means is provided with transfer elements for displacing the centre of gravity of the supporting force acting on said loading shoe in the direction of movement of the web to be dewatered.

The invention is based on the idea of displacing the centre of gravity of the supporting force acting on the loading shoe with respect to the shoe in order to adjust the pressure pattern produced by said shoe according to the requirements imposed by different paper qualities. The shoe then pivots around an imaginary axis located at the centre of gravity of the supporting force, by the effect of the forces produced by the pressure acting on the surface of the shoe, to a position in which the centre of gravity of the acting force of the pressure pattern formed is located at the same point as the centre of gravity of the supporting force. The displacement of the centre of gravity can be effected in two different ways, either by using a movable support means which is displaced mechanically with respect to the shoe so that the position of the centre of gravity of the supporting force acting on the shoe is changed with respect to the shoe, or by using a stationary support means by means of which the magnitude of the supporting force acting on the shoe can be hydraulically adjusted between the leading and trailing edges of the shoe so that the position of the centre of gravity of the supporting force is changed with respect to the shoe.

Figure 2:
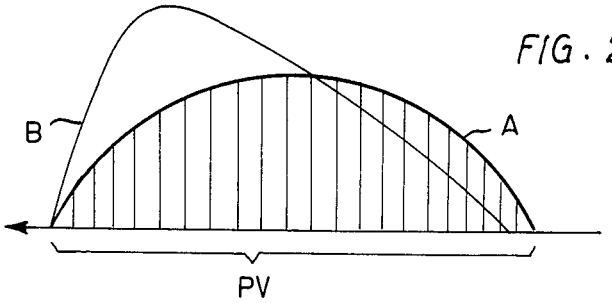
Figure 7:
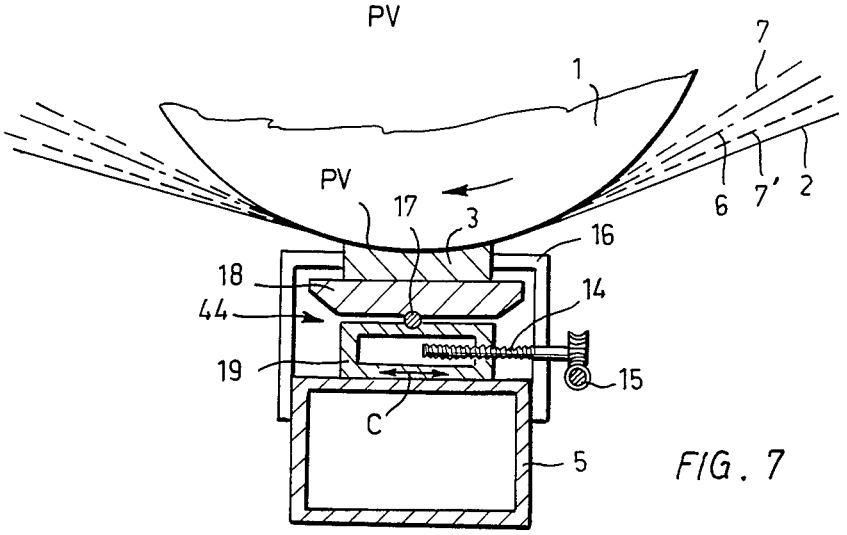
Figure 3:
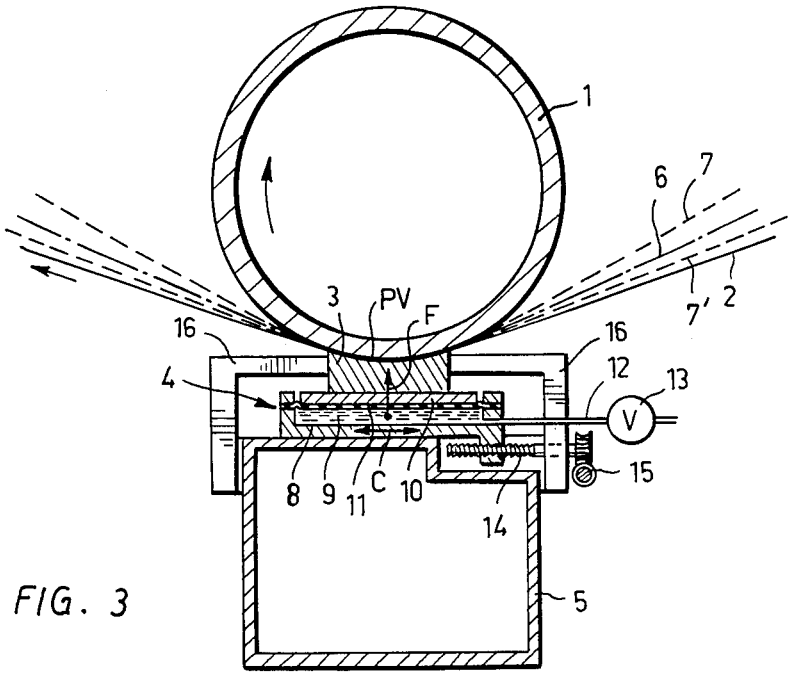
Figure 4:
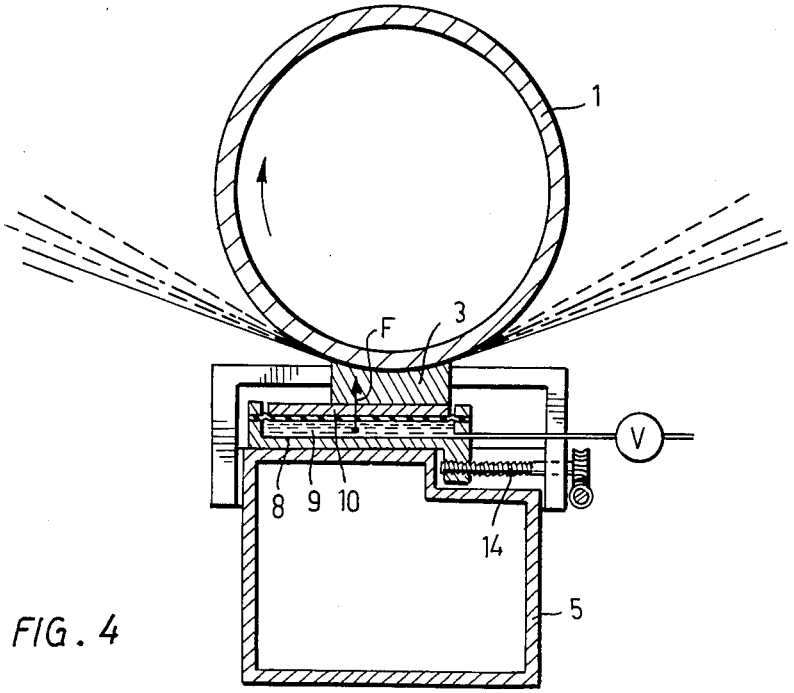
Figure 5:
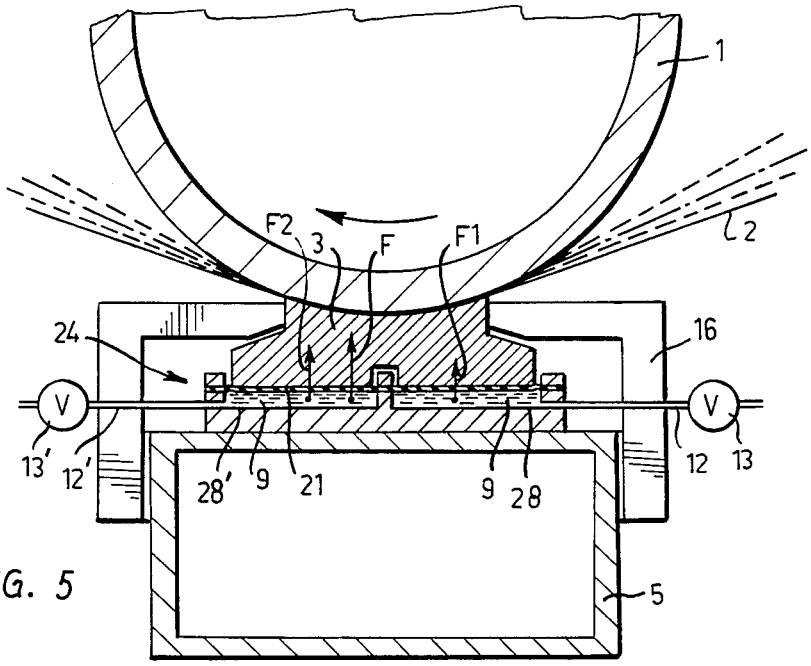
Figure 6:
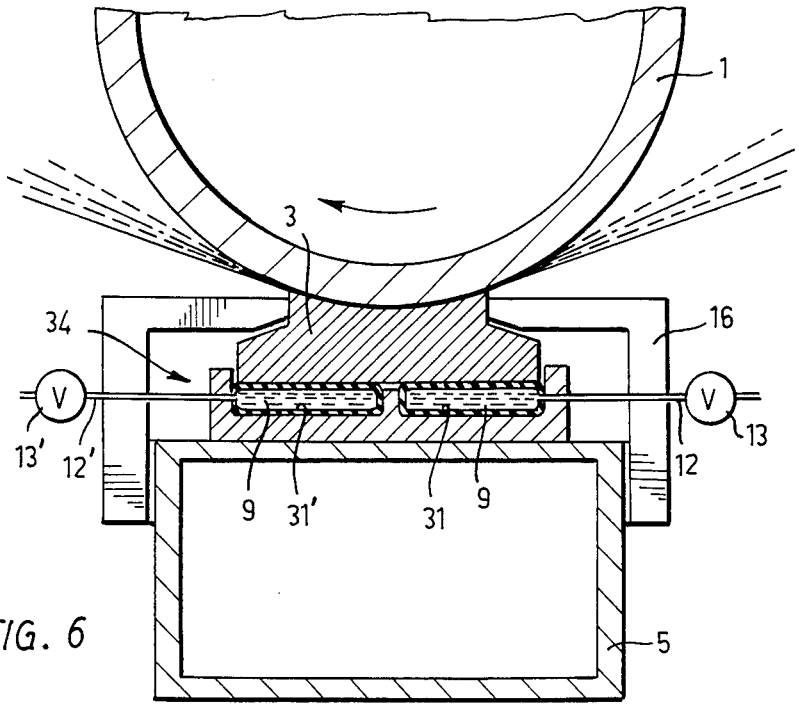

In the following, the invention will be described in more detail with reference to the accompanying drawings, wherein FIG. 1 is a side view of the operating principle of a press according to the invention as a vertical section, FIG. 2 shows two pressure patterns obtained by means of the press according to FIG. 1, FIGS. 3 and 4 show a first embodiment of the press in two different operating positions, FIG. 5 shows a second embodiment of the press, FIG. 6 shows a third embodiment of the press, and FIG. 7 shows a fourth embodiment of the press.

FIG. 1 of the drawings shows an extended nip press comprising a rotating press roll 1 and an endless band 2 which is impermeable to a pressure medium and is by means of band guide rolls guided so as to be pressed against a portion of the peripheral face of the press roll.

The press further comprises a loading shoe 3 which is parallel to the axis of the press roll and supported on a frame beam (not shown in the drawing). The loading shoe is pressed against the band 2 so that an extended press zone PV is formed on that area of the peripheral surface of the press roll on which the shoe loads the band.

The paper web 6 to be dewatered is passed between felts 7 and 7' through the press zone between the press roll and the band for pressing moisture out of the wet web into the felt (felts).

In the situation according to FIG. 1, the forces produced by the pressure, which act on the loading shoe 3 and are distributed on the area between the leading and trailing edges of the shoe, are represented by a supporting force A and B, respectively, passing through the centre of gravity of the forces. When the forces act symmetrically on the shoe, a uniform pressure pattern A, FIG. 2, is obtained in the press zone, but when the supporting forces act unsymmetrically on the shoe, an unsymmetric pressure pattern B, FIG. 2, is obtained.

The press in accordance with the invention is characterized in that the location of the centre of gravity of the supporting forces acting on the shoe in the loading direction can be selected in the direction of movement C of the web to be dewatered, whereby the pressure pattern produced by the shoe can be adjusted as required.

In the press zone shown in FIGS. 3 and 4, the support means 4 forms a chamber 8, which is filled with a pressure fluid 9. Between the chamber and the shoe, there is a loose plate-like foundation 10 which is mounted movably with respect to the shoe 3 and which is fastened to a membrane 11 limiting the pressure fluid and, at its edges, fastened to the chamber 8. The pressure fluid chamber extends in the axial direction of the press roll at least over the entire width of the press zone and is provided with a feed line 12, which can be connected to a pressure medium source (not shown) and which is provided with a closure valve 13. The pressure fluid 9 in the chamber 8 forms a pressure cushion which floatably supports the foundation 10. The pressure force is produced either by loading the roll 1 against the shoe 3, or the other way round. It is also possible to lock the roll 1 and the shoe 3 with respect to each other vertically stationarily and to produce the pressure force by pressurizing the chamber 8.

The bottom of the pressure medium chamber of the support means is parallel to the foundation 10 so that the support means is displaceable in the direction of the arrow C between the shoe and the frame beam 5. For this reason, the press is provided with a set screw 14, which is rotably journalled on some stationary frame portion of the press and which is in threaded engagement with the chamber 8. The set screw is engageable by means of the drive shaft 15. The shoe 3 is, for keeping its place in the direction of movement of the web, supported by means of a support 16 fastened to the frame of the press.

When the support means is located in accordance with FIG. 3 centrally underneath the shoe 3, the support effect of the support means is also distributed symmetrically onto the shoe, as is indicated by the support force F drawn through the centre of gravity of the support in FIG. 3. The pressure pattern produced within the press zone is thereby in accordance with curve A in FIG. 2. When the support means is shifted by means of the set screw in either direction, the centre of gravity of the support force F is also shifted in relation to the shoe, FIG. 4, so that the support of the shoe becomes eccentric and the pressure pattern produced in the press zone becomes similar to curve B in FIG. 2. Thus, owing to the displaceability of the support means, the pressure pattern can be readily adjusted for different paper qualities.

In order to keep the shoe stationary in the direction of movement of the web to be dewatered, the shoe is supported against the frame beam by means of support rods 16.

In the press shown in FIG. 5, the support means 24 is provided with two chambers 28 and 28', which are located one after the other in the direction of movement of the web, isolated from each other, and which are filled with a pressure fluid 9. An elastic membrane 21 is installed across the pressure fluid space, the edges and the middle portion of said membrane being fixed to the chambers. The chambers hereby form pressure cushions which support the shoe floatingly. The membrane may also consist of two separate membranes.

The adjustment of the pressure pattern takes place by adjusting the pressures in the chambers 28 and 28' in relation to each other. When the pressures are equal, the resultant of the support forces formed at the chambers is placed at the middle of the shoe 3, and in this case a pressure pattern in accordance with curve A in FIG. 2 is obtained. When the pressures in the chambers 28 and 28'are different, the joint resultant F of the resultants F1 and F2 of the support forces formed at both chambers is unsymmetric relative the shoe 3, whereby the result is, e.g., a pressure pattern in accordance with curve B in FIG. 2. The adjustment can be performed easily by means of closure valves 13 and 13' connected with the chambers 28 and 28' via pipes 12 and 12'. It is also possible to perform the adjustment by operating one of the closure valves 13 and 13' only. By means of the individual closure valves 13, 13' of the pressure chambers it is possible to adjust the pressures in the pressure fluid cushions, and consequently also the pressure pattern, easily for different paper qualities even during running.

The press shown in FIG. 6 differs from that shown in FIG. 5 in the respect that both of the pressure medium chambers of the support means 34 are formed out of separate pressure fluid containers or bags 31, 31'. The operation is the same as in the support means shown in FIG. 5.

FIG. 7 shows a press in which the pressure fluid chamber has been replaced by an articulated joint 17. Here the form of the pressure pattern can also be affected by adjusting the position of the support means 44 in the direction of running C of the web to be dewatered. Below the press shoe 3 there is a foundation 18, which is fitted movably in relation to the shoe 3. Underneath the foundation 18 there is a support piece 19, and between the foundation 18 and the support piece 19 there is an articulated joint 17, which forms an axis which is parallel to a longitudinal axis of the shoe 3 and around which the foundation 18 can pivot. The support piece 19 and the foundation 18 are displaceable in the direction of running C of the web by means of a set screw 14, whereby, at the same time, the position of the joint 17 relative the shoe 3 is changed and thereby the pressure pattern can be adjusted in the desired way. The shoe is kept stationary in the direction of running of the web by a support 16 fixed to the frame.

The drawings and the related description are only supposed to illustrate the idea of the invention. In its details the press in accordance with the invention may show even considerable variation within the scope of the patent claims.

For example, the support 16 for holding the shoe 3 in the direction of running of the web may be of any known construction whatsoever. Instead of a set screw, the means for adjusting the pressure pattern may be a rack mechanism, an eccentric construction, a cam or crank shaft mechanism, a hydraulic cylinder or any other solution known in prior art. Instead of one long pressure chamber, if desired, several shorter chambers may be used, etc.

What I claim is:

1. An extended nip press for a paper machine for removing water from a wet paper, cardboard or similar fibrous or porous web, said press comprising a rotating press roll, at least one stationary loading shoe parallel to the axis of said press roll and pivotable around an axis parallel to said axis, said loading shoe together with said press roll forming an extended press zone, at least one dewatering felt passing between said press roll and a band for passing the web to be dewatered through said press zone, and a support means located between said loading shoe and its supporting frame for applying a supporting force on said loading shoe, said supporting force pressing said loading shoe against said press roll, said support means being provided with transfer elements for displacing the centre of gravity of the supporting force acting on said loading shoe in the direction of movement of the web to be dewatered.

2. Press as claimed in claim 1, wherein said support means comprises at least one closed pressure medium chamber placed between said loading shoe and said support frame, said chamber being parallel to the longitudinal direction of said press roll and said chamber being, in the direction of running of the web to be dewatered, longer than said press zone, and said support means being provided with transfer means for displacing said pressure medium chamber in relation to said loading shoe in the direction of running of the web to be dewatered.

3. Press as claimed in claim 2, wherein said support means comprises a foundation supported floatably by a pressure fluid, said foundation supporting said loading shoe, said loading shoe being, by means of support means, supported on said support frame so as to be stationary in the direction of running of the web to be dewatered and said foundation being fitted as displaceable in relation to said loading shoe in the direction of running of said web.

4. Press as claimed in claim 3, wherein said foundation is attached to a flexible membrane, which is limited by said pressured fluid in said pressure medium chamber and is attached to the edges of a recess provided in said support means so as to form a closed pressure cushion with adjustable pressure.

5. Press as claimed in claim 2, wherein said transfer means of said pressure medium chamber comprise a setting mechanism acting between said displaceable chamber and said stationary support frame.

6. Press as claimed in claim 1, wherein said support means comprises at least two from each other separated closed pressure medium chambers placed between said loading shoe and said support frame, said chambers being parallel to the longitudinal direction of said press roll and being placed one after the other in the direction of running of the web to be dewatered, and at least one of said chambers being provided with means for adjusting the pressure in said chamber.

7. Press as claimed in claim 6, wherein said pressure medium chambers in said support means jointly support said loading shoe floatably, said loading shoe being, by means of support means, supported on said support frame, being stationary in the direction of running of the web to be dewatered.

8. Press as claimed in claim 7, wherein said pressure medium chambers in said support means are formed by attaching a flexible membrane onto the edges of recesses provided in said support means.

9. Press as claimed in claim 7, wherein said pressure medium chambers in said support means are formed out of separate flexible pressure fluid containers.

10. Press as claimed in claim 1, wherein said support means comprises a foundation mounted movably in the direction of running of said web in relation to said loading shoe and supporting said loading shoe, a support piece mounted displaceably in relation to said press frame in the direction of running of said web, an articulated joint parallel to the axis of said roll, placed between said foundation and said support piece, said foundation being supported by said support piece pivotably in respect of said articulated joint, as well as a support means for supporting said loading shoe onto said frame as stationary in the direction of running of said web.

11. Press as claimed in claim 5 wherein said setting mechanism is a set screw.

12. An extended nip press for a paper machine for removing water from a wet paper, cardboard or similar fibrous or porous web, said press comprising a rotating press roll, at least one stationary loading shoe parallel to the axis of said press roll and pivotable around an axis parallel to said axis, said loading shoe together with said press roll forming an extended press zone in which a pressure pattern is produced, at least one dewatering felt passing between said press roll and a band for passing the web to be dewatered through said press zone, and movable support means located between said loading shoe and its supporting frame for applying a supporting force on said loading shoe, said supporting force pressing said loading shoe against said press roll, said movable support means being movable in the direction of running of said web for mechanically displacing the centre of gravity of the supporting force acting on said loading shoe in the direction of movement of the web to be dewatered thereby adjusting the pressure pattern produced in the press zone.

13. An extended nip press for a paper machine for removing water from a wet paper, cardboard or similar fibrous or porous web, said press comprising a rotating press roll, at least one stationary loading shoe parallel to the axis of said press roll and pivotable around an axis parallel to said axis, said loading shoe together with said press roll forming an extended press zone in which a pressure pattern is produced, at least one dewatering felt passing between said press roll and a band for passing the web to be dewatered through said press zone, and support means located between said loading shoe and its supporting frame for applying a supporting force on said loading shoe, said supporting force pressing said loading shoe against said press roll, said support means including at least two closed pressure medium chambers separate from each other placed between said loading shoe and said support frame, said chambers being parallel to the longitudinal direction of said press roll and being placed one after the other in the direction of running of the web to be dewatered, and at least one of said chambers being provided with means for adjusting the pressure in said chamber for hydraulically displacing the centre of gravity of the supporting force acting on said loading shoe in the direction of movement of the web to be dewatered thereby adjusting the pressure pattern produced in the press zone.

14. Press as claimed in claim 10 wherein said articulated joint defines an axis substantially parallel to the longitudinal axis of said shoe, said foundation being pivotable about the axis defined by said articulated joint.

* * * * *

US004713147B1

REEXAMINATION CERTIFICATE (3088th)

United States Patent [19]

Saarinen

[11] B1 4,713,147

[45] Certificate Issued Dec. 31, 1996

[54] EXTENDED NIP PRESS WITH DISPLACEABLE CENTRE OF GRAVITY FOR THE SUPPORTING FORCE

[75] Inventor: Esko Saarinen, Tampere, Finland

[73] Assignee: Valmet Paper Machinery Inc., Helsinki, Finland

Reexamination Request:
No. 90/004,158, Mar. 10, 1996

Reexamination Certificate for:

| | |
|---|---|
| Patent No.: | **4,713,147** |
| Issued: | **Dec. 15, 1987** |
| Appl. No.: | **489,830** |
| Filed: | **Apr. 29, 1983** |

[30] Foreign Application Priority Data

May 5, 1982 [FI] Finland ..... 821584

[51] Int. Cl.[6] ..... D21F 3/06

[52] U.S. Cl. ..... 162/358.3; 100/118; 100/153; 162/205

[58] Field of Search ..... 162/358.3, 361

[56] References Cited

U.S. PATENT DOCUMENTS

| | | | |
|---|---|---|---|
| Re. 30,268 | 5/1980 | Justus . | |
| 3,011,545 | 12/1961 | Welsh et al. . | |
| 3,269,893 | 8/1966 | Rojecki . | |
| 3,293,121 | 12/1966 | Martin . | |
| 3,974,026 | 8/1976 | Emson et al. | 162/358.3 |
| 4,091,517 | 5/1978 | Lehmann et al. . | |
| 4,287,021 | 9/1981 | Justus et al. | 162/358.3 |
| 4,328,744 | 5/1982 | Pav et al. | 100/162 B |
| 4,394,793 | 7/1983 | Pav et al. . | |
| 4,425,190 | 1/1984 | Cronin | 162/358.3 |
| 4,427,492 | 1/1984 | Cronin . | |
| 4,428,797 | 1/1984 | Cronin . | |

FOREIGN PATENT DOCUMENTS 2060822 10/1979 United Kingdom .

*Primary Examiner*—Karen M. Hastings

[57] ABSTRACT

An extended nip press for a paper machine for removing water from a wet paper, cardboard or similar fibrous or porous web. The press comprises a rotating press roll and at least one loading shoe, which is pressed against the press roll so as to form an extended press zone. The loading shoe may pivot around an axis parallel to the axis of the press roll. The web to be dewatered is passed through the pressing zone together with at least one felt that receives water. The loading shoe is supported onto the support frame by the intermediate of a support means. The center of gravity of the support force applied by the support means to the shoe is displaceable in the direction of running of the web to be dewatered for the purpose of adjustment of the pressure pattern produced in the press zone when different paper qualities are run. The displacing of the center of gravity of the support force is performed either mechanically by shifting the support means in relation to the shoe, or hydraulically by changing the pressure in the two separate pressure cushions in the support means.

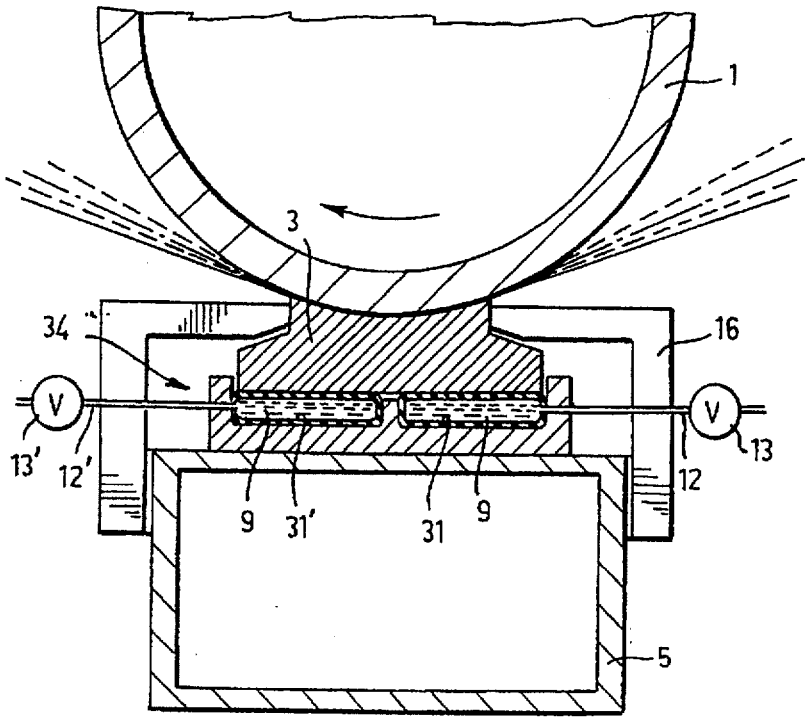

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS

BEEN DETERMINED THAT:

The patentability of claims 1–14 is confirmed.

* * * * *

US004713147B1

REEXAMINATION CERTIFICATE (3367th)

United States Patent [19]

Saarinen

[11] B2 4,713,147

[45] Certificate Issued Nov. 4, 1997

[54] EXTENDED NIP PRESS WITH DISPLACEABLE CENTER OF GRAVITY FOR THE SUPPORTING FORCE

[75] Inventor: Esko Saarinen, Tampere, Finland

[73] Assignee: Valmet Paper Machinery Inc., Helsinki, Finland

Reexamination Request:
No. 90/004,566, Feb. 28, 1997

Reexamination Certificate for:

| | |
|---|---|
| Patent No.: | **4,713,147** |
| Issued: | **Dec. 15, 1987** |
| Appl. No.: | **489,830** |
| Filed: | **Apr. 29, 1983** |

Reexamination Certificate B1 4,713,147 issued Dec. 31, 1996

[30] Foreign Application Priority Data

May 5, 1982 [FI] Finland ..... 821584

[51] Int. Cl.[6] ..... D21F 3/06

[52] U.S. Cl. ..... 162/358.3; 100/118; 100/153; 162/205

[58] Field of Search ..... 162/358.3

[56] References Cited

U.S. PATENT DOCUMENTS

| | | | |
|---|---|---|---|
| Re. 30,268 | 5/1980 | Justus | 162/358.3 |
| 1,532,660 | 4/1925 | Patterson . | |
| 3,011,545 | 12/1961 | Welsh et al. . | |
| 3,269,893 | 8/1966 | Rojecki . | |
| 3,293,121 | 12/1966 | Martin | 162/358 |
| 3,556,939 | 1/1971 | Stenberg | 162/313 |
| 3,587,451 | 6/1971 | Luthi | 100/118 |
| 3,974,026 | 8/1976 | Emson et al. | 162/358.3 |
| 4,091,517 | 5/1978 | Lehmann et al. . | |
| 4,287,021 | 9/1981 | Justus et al. | 162/205 |
| 4,328,744 | 5/1982 | Pav et al. . | |
| 4,394,793 | 7/1983 | Pav et al. . | |
| 4,425,190 | 1/1984 | Cronin | 162/358.3 |
| 4,427,492 | 1/1984 | Cronin . | |
| 4,428,797 | 1/1984 | Cronin . | |
| 4,973,384 | 11/1990 | Crouse et al. . | |
| 5,167,768 | 12/1992 | Cronin et al. . | |

FOREIGN PATENT DOCUMENTS 2060822 10/1979 United Kingdom .

*Primary Examiner*—K. M. Hastings

[57] ABSTRACT

An extended nip press for a paper machine for removing water from a wet paper, cardboard or similar fibrous or porous web. The press comprises a rotating press roll and at least one loading shoe, which is pressed against the press roll so as to form an extended press zone. The loading shoe may pivot around an axis parallel to the axis of the press roll. The web to be dewatered is passed through the pressing zone together with at least one felt that receives water. The loading shoe is supported onto the support frame by the intermediate of a support means. The center of gravity of the support force applied by the support means to the shoe is displaceable in the direction of running of the web to be dewatered for the purpose of adjustment of the pressure pattern produced in the press zone when different paper qualities are run. The displacing of the center of gravity of the support force is performed either mechanically by shifting the support means in relation to the shoe, or hydraulically by changing the pressures in the two separate pressure cushions in the support means.

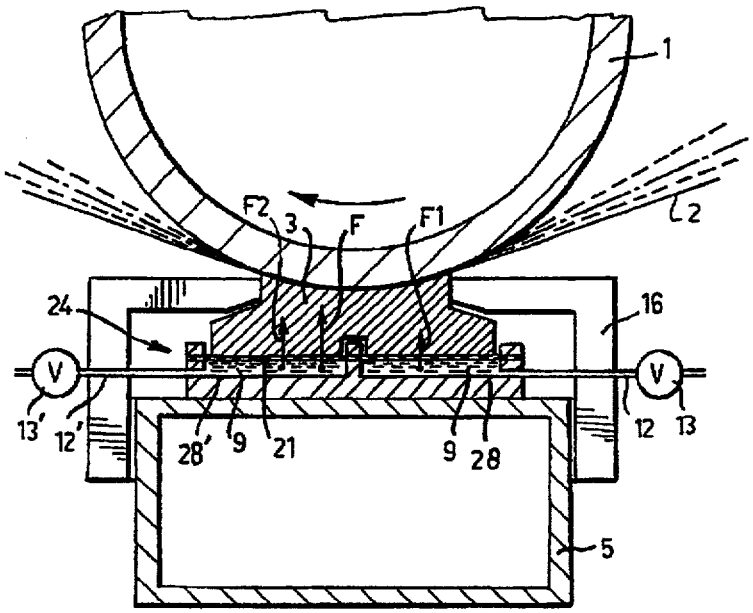

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–14 is confirmed.

* * * * *